US011345058B2

(12) United States Patent
Dawidziak et al.

(10) Patent No.: US 11,345,058 B2
(45) Date of Patent: May 31, 2022

(54) MACHINE AND METHOD FOR MACHINING, IN PARTICULAR PLANING, CONICAL WORKPIECES OF WOOD, PLASTICS, AND THE LIKE

(71) Applicant: Michael Weinig AG, Tauberbischofsheim (DE)

(72) Inventors: Albrecht Dawidziak, Großrinderfeld (DE); Klaus Weisenseel, Ahorn-Berolzheim (DE)

(73) Assignee: Michael Weinig AG, Tauberbischofsheim (DE)

( * ) Notice: Subject to any disclaimer, the term of this patent is extended or adjusted under 35 U.S.C. 154(b) by 316 days.

(21) Appl. No.: 16/368,904

(22) Filed: Mar. 29, 2019

(65) Prior Publication Data

US 2019/0299483 A1 Oct. 3, 2019

(30) Foreign Application Priority Data

Mar. 29, 2018 (DE) ..... 10 2018 002 704.0
Mar. 16, 2019 (DE) ..... 10 2019 001 921.0

(51) Int. Cl.
*B27F 1/06* (2006.01)
*B27F 5/02* (2006.01)
(Continued)

(52) U.S. Cl.
CPC ..... *B27F 1/06* (2013.01); *B27C 5/06* (2013.01); *B27F 5/026* (2013.01); *B27B 5/29* (2013.01)

(58) Field of Classification Search
CPC .. B27B 1/00; B27B 1/007; B27B 5/04; B27C 1/08; B27C 5/06; B27F 5/026; B27D 1/10
See application file for complete search history.

(56) References Cited

U.S. PATENT DOCUMENTS 769,980 A 9/1904 Borg
3,934,630 A * 1/1976 Cockle ..... B27B 1/00 144/39
(Continued)

FOREIGN PATENT DOCUMENTS

BE 1016561 1/2007
DE 1453 217 2/1969
(Continued)

*Primary Examiner* — Matthew Katcoff
(74) *Attorney, Agent, or Firm* — Gudrun E. Huckett

(57) ABSTRACT

A machine for conical machining workpieces of wood and plastics has a support supporting the workpieces during feeding in a transport direction through the machine. Rotatably driven tools are provided to machine longitudinal sides of the workpieces extending in the transport direction. At least one of the rotatably driven tools is adjustable transverse to the transport direction. A tongue and groove guide guides the workpieces through the machine in transport direction. In a method for conical machining workpieces, the workpieces prior to or during feeding are measured in regard to the conicity to be machined. A form-fit element is produced on the workpieces and interacts with a counter form-fit element during feeding of the workpieces so as to guide the workpieces in transport direction. At least one of the rotatably driven tools is adjusted transverse to the transport direction during feeding of the workpieces based on the measured conicity.

14 Claims, 10 Drawing Sheets

(51) Int. Cl.
*B27C 5/06* (2006.01)
*B27B 5/29* (2006.01)

(56) References Cited

U.S. PATENT DOCUMENTS

| | | | | | |
|---|---|---|---|---|---|
| 4,230,163 | A | * | 10/1980 | Barton | B27C 5/00 144/116 |
| 5,447,186 | A | * | 9/1995 | Achard | B27B 1/007 144/116 |
| 6,062,281 | A | * | 5/2000 | Dockter | B27B 1/007 144/3.1 |
| 9,827,643 | B2 | * | 11/2017 | Barker | B23Q 17/20 |
| 2011/0079324 | A1 | * | 4/2011 | Appeldoorn | B27B 5/04 144/376 |
| 2015/0197031 | A1 | | 7/2015 | Kennedy et al. | |

FOREIGN PATENT DOCUMENTS

| | | |
|---|---|---|
| DE | 1 801 524 | 5/1969 |
| DE | 196 16 165 | 10/1997 |
| DE | 197 56 503 | 6/1999 |
| DE | 103 28 204 | 2/2005 |
| DE | 10 2004 054 973 | 7/2006 |
| WO | 2015/086332 | 6/2015 |

* cited by examiner

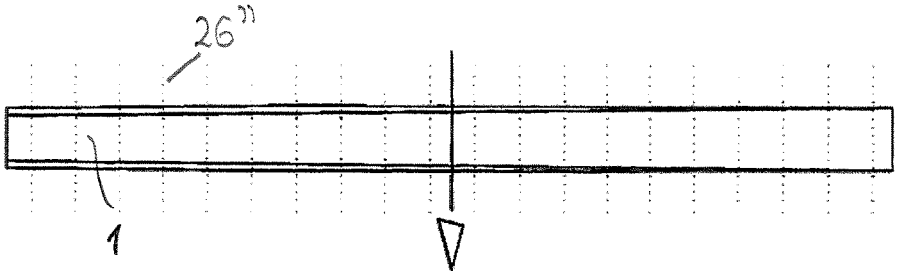
Fig. 10.1
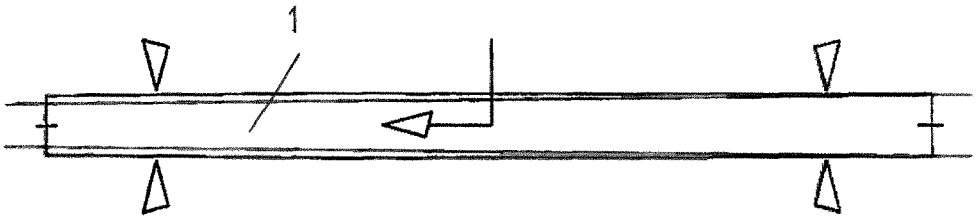
Fig. 10.2
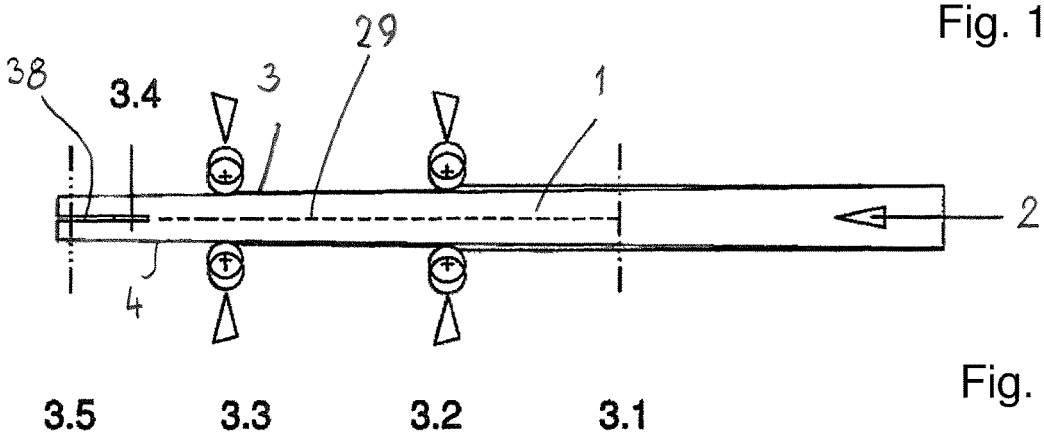
Fig. 10.3
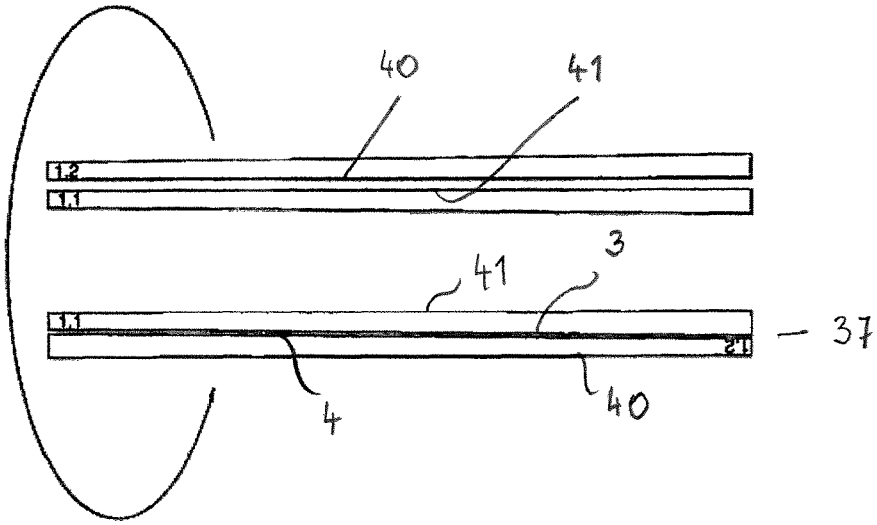
Fig. 10a
Fig. 10b

MACHINE AND METHOD FOR MACHINING, IN PARTICULAR PLANING, CONICAL WORKPIECES OF WOOD, PLASTICS, AND THE LIKE

BACKGROUND OF THE INVENTION

The invention relates to a machine for conical machining, in particular for conical planing, workpieces of wood, plastics, and the like that can be transported through the machine, comprising at least one support for the workpieces and at least two rotatably driven tools with which the right and/or the left longitudinal side of the workpieces, viewed in transport direction of the workpieces, are machined, and wherein at least one of the tools is adjustable transverse to the transport direction.

The invention relates furthermore to a method for machining, in particular for conical planing, such workpieces of wood, plastics, and the like, in particular by using a machine of the aforementioned kind, wherein the right and/or the left longitudinal side of the workpieces, viewed in transport direction of the workpieces, is machined by at least one tool in accordance with the method.

For producing flat areal elements, conical workpieces, which in general are lamella-shaped workpieces or boards with parallel topside and bottom side and conically tapering straight longitudinal sides, are glued together at these conical sides that are resting against each other. The thus obtained panel-shaped elements can be stacked on each other in order to produce in this way walls, for example. It is required that the corresponding sides of the starting workpieces, which can be mill-run untrimmed or trimmed boards based on the naturally grown shape of the tree trunks, are clean-cut so that the conical workpieces can be properly joined side by side. For this purpose, the workpiece sides are planed by tools, in particular by rotating cutter heads. However, it is difficult to transport the workpieces through a machine such that the required high precision and/or surface quality can be achieved simply and easily.

Therefore, in most cases these single-layer panels or multi-layer panels, also referred to as cross-laminated timber element, are produced from boards with rectangular cross section with respective parallel wide and parallel narrow longitudinal sides, i.e., with identical rectangular cross-section across their length.

It is the object of the invention to configure the machine of the aforementioned kind and the method of the aforementioned kind such that the workpieces can be machined in a simple way with high precision and/or quality.

SUMMARY OF THE INVENTION

In accordance with the invention, this is achieved in regard to the machine in that, for transport of the workpieces through the machine, at least one tongue and groove guide that is effective in transport direction is provided.

In connection with the method, the object is achieved in that the workpieces, prior to being fed or while being fed, are measured with regard to at least the conicity to be machined, in that at the workpiece at least one form-fit element is produced that is interacting with at least one counter form-fit element during transport of the workpiece through the machine in such a way that the workpiece is guided in the transport direction, and in that the tool during feedthrough of the workpiece is adjusted transverse to the transport direction as a function of the determined conicity of the workpiece.

The machine according to the invention is characterized in that the workpieces are transported in the transport direction through the machine by the tongue and groove guide. In this way, the corresponding longitudinal sides of the workpiece can be machined with high precision and/or quality. In particular, a high quality ready for gluing can be achieved so that the workpieces after their machining can be joined to flat areal elements in a proper way by being pressed against each other with their longitudinal sides to which glue has been applied.

Advantageously, the tongue and groove guide comprises at least one web (tongue) extending in transport direction and engaging a groove provided at the workpiece that is also extending in the transport direction. The web forms thus a guide web with which the workpieces can be transported properly during transport through the machine. Depending on the position of the workpiece side to the right or to the left in transport direction, the corresponding two tools can be adjusted such during transport that a straight conical machining with optimal material removal is realized at these workpiece sides. The groove can be produced in a simple way at the workpiece and ensures in connection with the machine-associated web that the workpiece is transported, exactly aligned, through the machine.

Advantageously, the machine-associated web is provided at the machine-associated support for the workpieces.

In an advantageous embodiment, the support is formed by a machine table. On such a machine table, the workpieces can be transported properly through the machine by resting thereon.

The machine-associated web extends at least to the level of the tools with which the workpiece side to the right and the left in transport direction is machined so that the workpieces are reliably guided while their sides are machined.

Advantageously, the web extends past the position of these tools advantageously across the entire length of the support. It is then reliably prevented that the workpiece, while being machined by the lateral tools, performs accidental movements that would impair the surface precision.

For producing the groove in the workpiece, advantageously a further tool is used which is provided in addition to the tools that machine workpiece sides to the right and the left in transport direction.

This additional tool in an advantageous embodiment is a horizontally arranged rotatably driven dressing tool. With it, the groove is produced, for example, by milling, at the bottom side of the workpiece during transport of the workpiece through the machine. Also, in an advantageous way it is possible to design the dressing tool such that additionally also the corresponding workpiece side can be dressed with it.

In order for the two tools machining the two workpiece sides to be adjustable exactly into their required positions, they are advantageously connected to a CNC control unit (CNC=computerized numerical control).

In an advantageous embodiment, measuring elements are connected to the CNC control unit that measure at least one workpiece side extending in transport direction.

In an advantageous embodiment, the measuring elements are formed by sensors which are capable of contactless measuring of the corresponding workpiece side and thus provide essentially a width profile of the starting workpiece. In principle, it is however also possible to employ as measuring elements a camera, measuring wheels, measuring rollers, or measuring shoes which are contacting the corresponding workpiece sides during transport of the workpiece through the machine and also transmit their signals to the CNC control unit.

The CNC control unit is advantageously embodied such that it evaluates the signals coming from the measuring elements and, in accordance with the evaluation, adjusts the tools transverse to the transport direction.

The conical workpieces can be fed to the machine in an aligned position such that, for example, the workpiece side to the right in transport direction is positioned parallel to the transport direction. In this case, the associated tool must be adjusted only to the position that is required for an optimal material removal at this workpiece side. During transport of the workpiece through the machine, this tool then remains in this position.

In this case, only the oppositely positioned workpiece side, i.e., in the transport direction the left workpiece side, is conical relative to the transport direction. The corresponding tool is then adjusted by the CNC control unit during transport of the workpiece through the machine in accordance with the feed travel of the workpiece.

In this way, it is very easily possible to produce different slant angles of the corresponding workpiece side.

When both workpiece sides are positioned at an angle to the transport direction, both tools are of course continuously adjusted transverse to the transport direction by means of the CNC control unit as a function of the feed travel of the workpiece during transport of the workpiece through the machine.

Measuring elements, for example, in the form of measuring wheels running on the topside of the workpieces can be employed so that the position and the transport distance of the workpieces in the machine can be precisely determined.

In an advantageous embodiment, at least one additional sensor can be provided for detecting the leading end of the workpiece.

In a preferred embodiment, the machine is embodied such that the support has upstream thereof at least one straightening table. It is provided with at least one fence extending in the transport direction against which the workpiece rests prior to being machined by the two tools.

The measuring elements with which the workpiece sides to the right and to the left in transport direction are measured are advantageously in the region of this straightening table.

In order for the tool or the tools to be adjusted timely to the required material removal positions as a function of the measurement of the workpiece sides by the measuring elements, the distance, measured in transport direction of the workpieces, between the measuring elements and the first tool to engage the workpiece must be greater than the length of the workpieces.

In the method according to the invention, the workpieces, prior to or even during their feed, are measured at least with regard to the conicity to be machined. At least one form-fit element extending in the transport direction of the workpiece is produced at the workpiece, preferably after measuring. During the transport of the workpiece, the form-fit element interacts with at least one counter form-fit element. It extends in transport direction of the workpiece. During feedthrough of the workpiece, the tool is adjusted transverse to the transport direction as a function of the determined conicity of the workpiece.

In a preferred embodiment, the position of the workpiece relative to the tool is determined. In this way, the tool can be adjusted optimally during workpiece throughfeed in such a way that, at minimal material removal, a high quality and/or the desired conicity of the longitudinal side of the workpiece is achieved. When these conical workpieces are subsequently joined side by side to panel-shaped elements and glued to each other, the high quality of the corresponding workpiece side ensures that the workpieces, resting against each other and glued to each other with these longitudinal sides, can be properly and fixedly joined to each other.

Advantageously, the width and/or the conicity of the workpiece is measured by measuring elements whose signals are transmitted to a control unit for the tools.

After conical machining, the workpieces are advantageously arranged in pairs to board pairs in that one workpiece is rotated by 180° about an axis perpendicular to its longitudinal direction. For identical conicity of the workpieces, the thus formed board pairs have parallel longitudinal sides and an approximately rectangular contour. As needed, the workpieces can be glued to each other at their contacting longitudinal sides; advantageously, this is however done later in a subsequent method step. In this context, the board pairs are arranged next to each other to an array of boards and are joined to each other in a suitable way, preferably are glued to each other.

The thus obtained board pairs are advantageously placed next to each other to an endless array of boards and fixedly joined to each other, preferably glued to each other. In this context, the boards are loaded transverse to their longitudinal sides and pressed transverse to their topside and bottom side. Since the board pairs have parallel outer longitudinal sides, a straight array of boards is formed.

In an advantageous control of the method, the workpieces are separated into two workpiece parts after conical machining. In this context, one of the two workpiece parts is rotated and forms together with the other workpiece part the board pair with parallel longitudinal sides and approximately rectangular contour.

Separating the finished workpieces can be done in two ways. In one variant, the workpieces are separated at half their length after conical machining in order to form the two workpiece parts.

In the other variant, the workpieces are separated, after conical machining, along an axis that is parallel to the symmetry axis or longitudinal axis of the workpiece in order to form the two workpiece parts, for example, by means of a saw. In this case, the two workpiece parts have the same length as the workpiece. In order to be able to form the board pairs with parallel longitudinal sides from the two workpiece parts, the conical machining of the two longitudinal sides is done symmetrical with identical angle and the saw cut is performed along an axis that is parallel to the symmetry axis of the workpieces. Preferably, the workpieces are separated at half their width along the symmetry axis.

The subject matter of the invention results not only from the subject matter of the individual claims but also from all specifications and features disclosed in the drawings and the description. They are claimed as important to the invention, even if they are not subject matter of the claims, inasmuch as, individually or in combination, they are novel relative to the prior art.

Further features of the invention result from the additional claims, the description, and the drawings.

The invention will be explained with the aid of some embodiments illustrated in the drawings.

BRIEF DESCRIPTION OF THE DRAWING

FIGS. 9.1, 9.2, and 9.3 illustrate an embodiment of the method according to the invention.

FIGS. 10.1, 10.2, and 10.3 illustrate another embodiment of the method according to the invention.

FIGS. 10*a* and 10*b* show schematically the method of forming board pairs.

DESCRIPTION OF THE PREFERRED EMBODIMENTS

Figure 3:
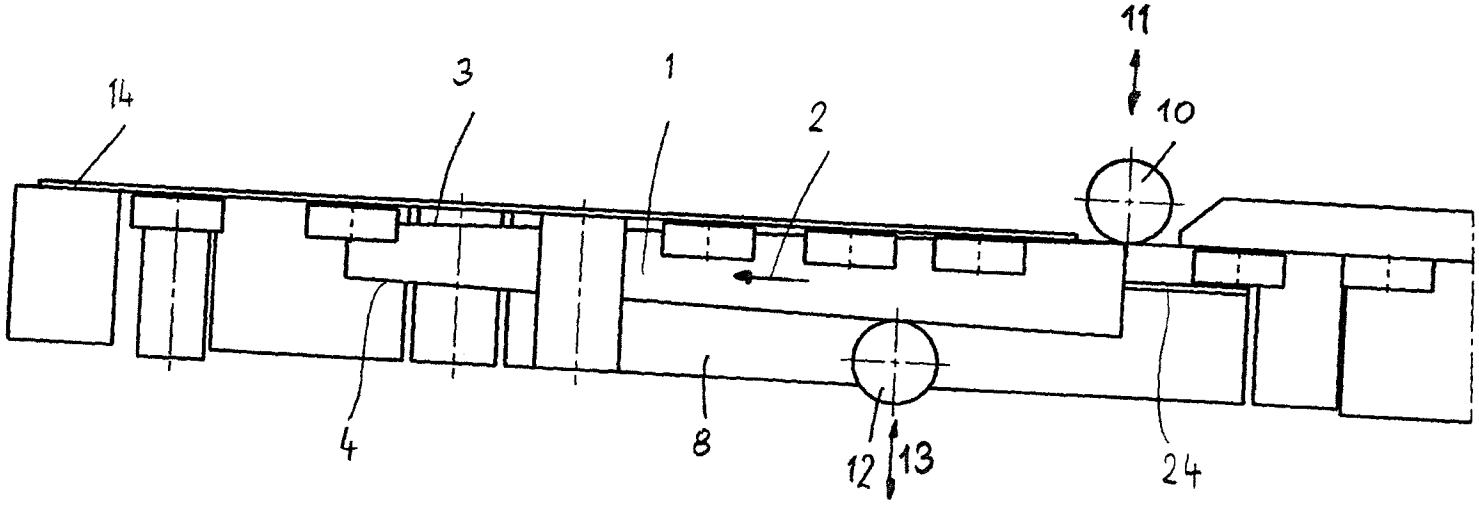
FIG. 3 shows in an illustration corresponding to FIG. 2 the machine, through which the conical board to be machined is transported, in a different position.

The machine described in the following is used for conical planing of workpieces 1 of wood, plastics, and the like in a throughfeed method. The longitudinal sides 3, 4 of the workpiece 1 to the right and to the left in the transport (or throughfeed) direction 2 are planed such that at least one longitudinal side is positioned at an acute angle relative to the transport direction 2. As shown in FIG. 3, the workpieces 1 can however also be planed such that both longitudinal sides 3, 4 each are positioned at an acute angle relative to the transport direction 2.

The workpieces 1 are board-like lamellas from which house walls are produced, for example. For this purpose, the conical workpieces 1 are fixedly joined with their longitudinal sides 3, 4 resting against each other, for example, by means of a corresponding adhesive (glue) layer. The conical workpieces 1 are placed against each other rotated by 180°, respectively. When forming a housing wall, for example, the workpieces 1 which are resting against each other and glued to each other are compressed transverse to the longitudinal sides 3, 4.

The machine for producing the conical workpieces 1 is a throughfeed machine with a straightening table 5 on which the workpieces 1 are fed to the machine. The straightening table 5 is arranged at the infeed side of the machine. For transporting the workpieces 1 on the straightening table 5, feed/transport rollers 6 are provided which are driven in rotation and on which the workpieces 1 are resting.

The straightening table 5 can be adjustable in vertical direction in order to adjust the size of material removal at the bottom side of the workpiece 1. At the right side, in the infeed direction, of the straightening table 5, the workpiece 1 with its longitudinal side 3 to the right relative to the throughfeed direction 2 is contacting a fence 7 extending in the throughfeed direction 2.

Figure 1:
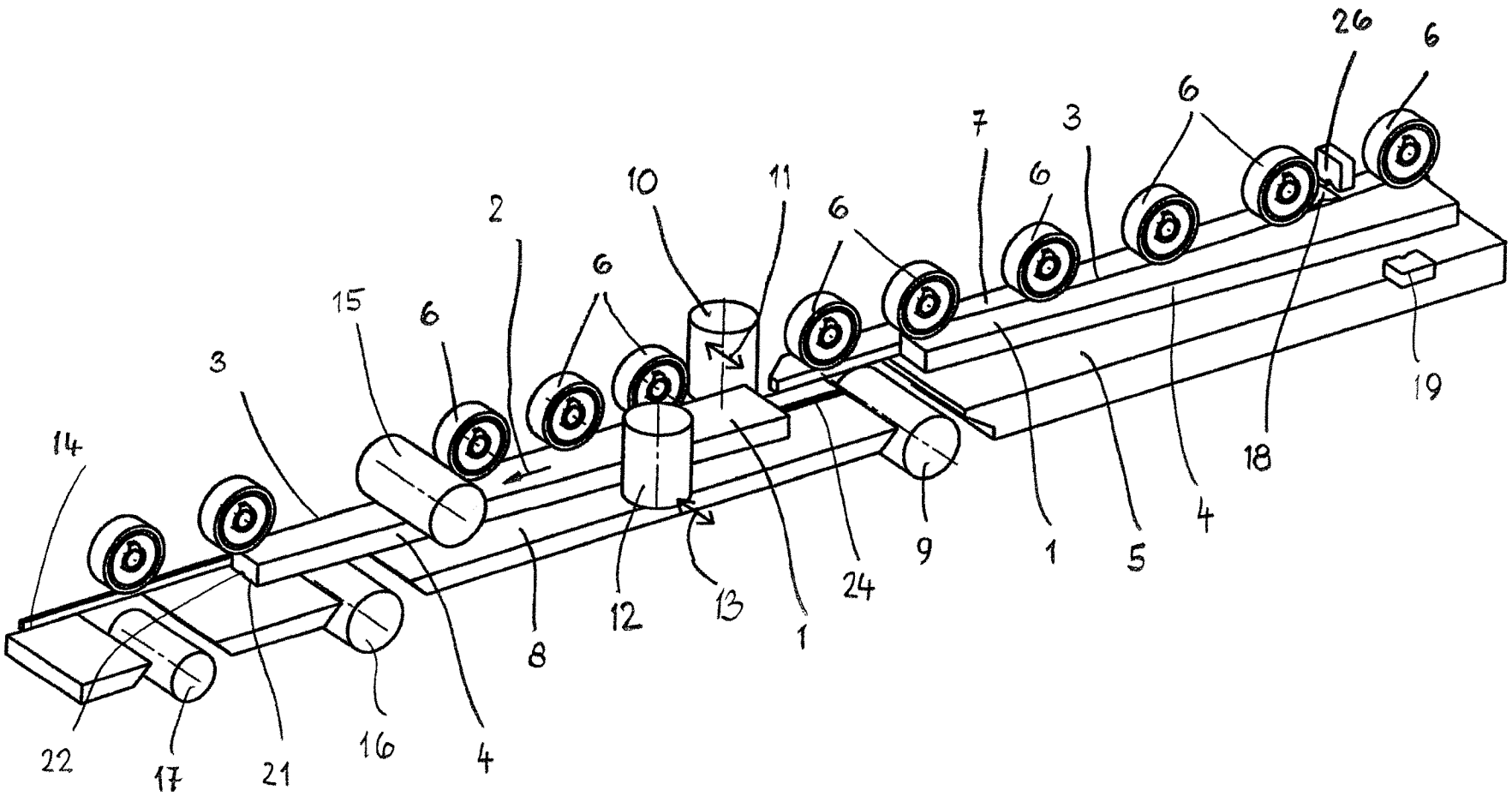
FIG. 1 shows in a simplified and perspective illustration a machine according to the invention for machining conical boards.

In the embodiment illustrated in FIG. 1, the right longitudinal side 3 of the workpiece 1 is provided with a curvature extending across its length so that the longitudinal side 3 of the workpiece 1 is resting only in the region of its leading end and its trailing end at the fence 7.

At the transition from the straightening table 5 to a machine table 8, a horizontal bottom dressing spindle is provided on which a dressing tool 9, only schematically illustrated, is seated fixedly. With the latter, the bottom side of the workpiece 1 is machined by material removal, preferably is planed straight, upon throughfeed of the workpiece 1. The material removal is determined by the height of the straightening table 5 relative to the dressing tool 9.

In throughfeed direction 2 downstream of the dressing tool 9, a right vertical spindle is provided on which a tool 10 is fixedly seated. With the tool 10, the longitudinal side 3 of the workpiece 1 to the right in transport direction 2 can be machined.

The tool 10 is a planing head with straight knives with which the longitudinal side 3 of the workpiece 1 during throughfeed is planed straight. The spindle supporting the tool 10 is adjustable transverse to the throughfeed direction 2. In FIG. 1, the adjusting direction 11 is perpendicular to the throughfeed direction 2 and is horizontal. In the throughfeed direction 2, advantageously at a spacing downstream of the right spindle, the machine is provided with a left vertical spindle on which a tool 12 is fixedly seated. The spindle of this tool 12 is also adjustable transversely, preferably perpendicularly, to the throughfeed direction 2 in horizontal direction. The corresponding adjusting direction is identified at 13.

During the throughfeed action, the workpiece 1 is resting with one of its wide sides on the machine table 8 which forms a horizontal support and reference plane for the workpieces 1.

In throughfeed direction 2, the workpieces 1 are guided through the machine at a minimal spacing to a fence 14 downstream of the right tool 10. The fence 14 is positioned parallel to the throughfeed direction 2 and is fixed on the machine.

The transport of the workpieces 1 on the machine table 8 is realized also with feed/transport rollers 6 which in the throughfeed direction 2 are arranged at a spacing one behind the other and are rotatably driven. The feed/transport rollers 6 are resting on the workpiece 1.

In the throughfeed direction 2 downstream of the left vertical spindle 12, the machine is provided with a horizontal top spindle on which tool 15 is seated fixedly. With the tool 15, the topside of the workpiece 1 is machined as the workpiece 1 is fed through the machine.

As shown also in FIG. 1, the machine is provided at a spacing downstream of the tool 15 with a horizontal bottom spindle on which a tool 16 is fixedly seated. With the tool 16, the bottom side of the workpiece 1 can be machined as the workpiece 1 is fed through.

In throughfeed direction 2 at a spacing downstream of the tool 16, the machine has a horizontal bottom table roller 17 for improved transport of the workpieces 1.

Figure 4:
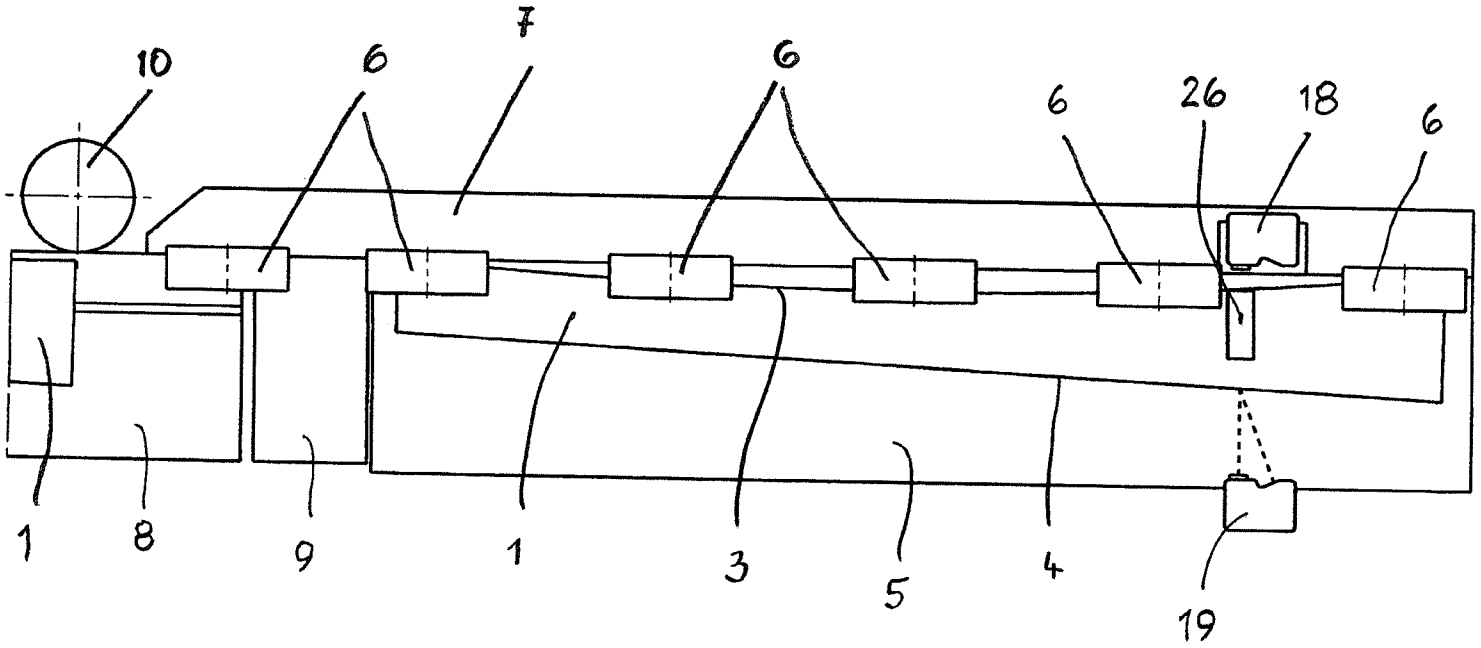
FIG. 4 shows in an enlarged illustration and in plan view a part of the machine according to the invention with a board whose one longitudinal side comprises a curvature across the length of the board.

The workpiece to be machined is fed via the straightening table 5 to the machine. In the region of the straightening table 5, there are two sensors 18 and 19 between which the workpiece 1 is transported in the direction toward the machine and the machine table 8. As can be seen in FIG. 4, the right longitudinal side 3 of the workpiece 1 is curved across its length. In FIG. 4, this curvature is shown exaggerated for clarity. Due to the curved longitudinal side 3 the workpiece 1 is contacting the fence 7 only with its leading end and its trailing end.

The curvature results from storage and drying, in case of untrimmed workpieces 1 as a result of the natural growth pattern of the tree trunk and in case of trimmed or partially trimmed workpieces as a result of released tension.

The workpieces 1 which are not yet machined are fed in the correct position, provided by means of an upstream mechanized apparatus, to the straightening table 5. In this upstream mechanized apparatus, the workpieces 1 are scanned and advantageously supplied such that the workpieces with the curved concave longitudinal side 3 are resting against the fence 7 of the straightening table 5.

Upon throughfeed of the workpiece 1 between the two sensors 18, 19, the two longitudinal sides 3, 4 of the workpiece 1 are advantageously scanned in a contactless way. The sensors 18, 19 can be, for example, laser-based distance sensors with which the longitudinal sides 3, 4 are scanned.

The sensors 18, 19 are connected to a control unit (not illustrated) to which the sensor signals are fed. Based on these sensor signals, the control unit then ensures that the tools 10, 12, downstream in throughfeed direction 2, are adjusted radially in such a way that at the longitudinal sides 3, 4 the required material removal is performed at the workpiece.

The two sensors 18, 19 are arranged stationarily. The amount of curvature or conicity of the workpiece 1 can be determined with them in a simple way.

The sensor 18 determines the material removal at the right longitudinal side 3 of the workpiece 1. Accordingly, by means of the control unit, the right tool 10 is adjusted radially in the adjusting direction 11 such that the initially curved longitudinal side 3 is planed straight by the tool 10. The tool 10 does not move during the straightening process but maintains its position that has been adjusted by the control unit during throughfeed of the workpiece 1.

The sensor 18 in throughfeed direction 2 has a spacing relative to the tool 10 that is greater than the greatest length of the workpiece 1 to be machined. The tool 10 can then be adjusted into the required radial position in the adjusting direction 11 before it engages the workpiece 1 that is fed from the straightening table 5, because the sensor 18 has already measured or scanned the workpiece 1 across its length and transmitted the corresponding sensor signals to the control unit.

The sensor 19 is positioned opposite the longitudinal side 4 of the workpiece 1 at a distance and scans the course of this longitudinal side 4 during throughfeed of the workpiece 1. By means of the sensor 19, the conicity of the workpiece 1 and the magnitude of material removal at the longitudinal side 4 by means of the tool 12 can be determined.

By means of sensor 19, the relative position of the longitudinal side 4 of the workpiece 1 relative to the throughfeed direction 2 can be easily determined. As illustrated in FIG. 4 in an exemplary fashion, the sensor beam 20 which is emitted by the sensor 19 is reflected at the longitudinal side 4 of the workpiece 1 back to the sensor 19 and, based thereon, the distance to the workpiece 1 relative to the sensor 19 is determined. Accordingly, essentially a continuous width measurement of the workpiece upon throughfeed is achieved.

The two tools 10, 12 are advantageously adjusted by CNC control action into their respective position in the adjusting direction 11, 13. Due to the slanted position of the longitudinal side 4, the tool 12, in contrast to tool 10, is adjusted accordingly in the adjusting direction 13 during throughfeed of the workpiece 1. In the embodiment according to FIG. 1, the tool 12 is first adjusted so far in the direction toward the fence 14 that the tool 12 at the narrow end of the workpiece 1 can remove material in the region of the longitudinal side 4. In accordance with the course of the longitudinal side 4, the tool 12 is retracted in adjusting direction 13 by CNC control so that the tool 12 has the greatest distance from the fence 14 when the workpiece 1 has been transported past the tool 12. Subsequently, by means of the control unit, the tool 12 is returned again into a starting position which depends on the width of the leading end of the following workpiece 1 in the throughfeed direction 2.

Before the tool 10 engages the workpiece 1, the tool 10, which during throughfeed of the workpiece 1 is fixed on the machine, is adjusted in the adjusting direction 11 by the control unit, based on the signals of the sensor 18, in such a way that, with only minimal material removal, at the longitudinal side 3 only so much material is removed from the workpiece 1 that the workpiece 1 comprises a straight longitudinal side 3 that extends parallel to the throughfeed direction 2 and is completely and cleanly planed properly across its length once it has been machined by the tool 10.

Figure 2:
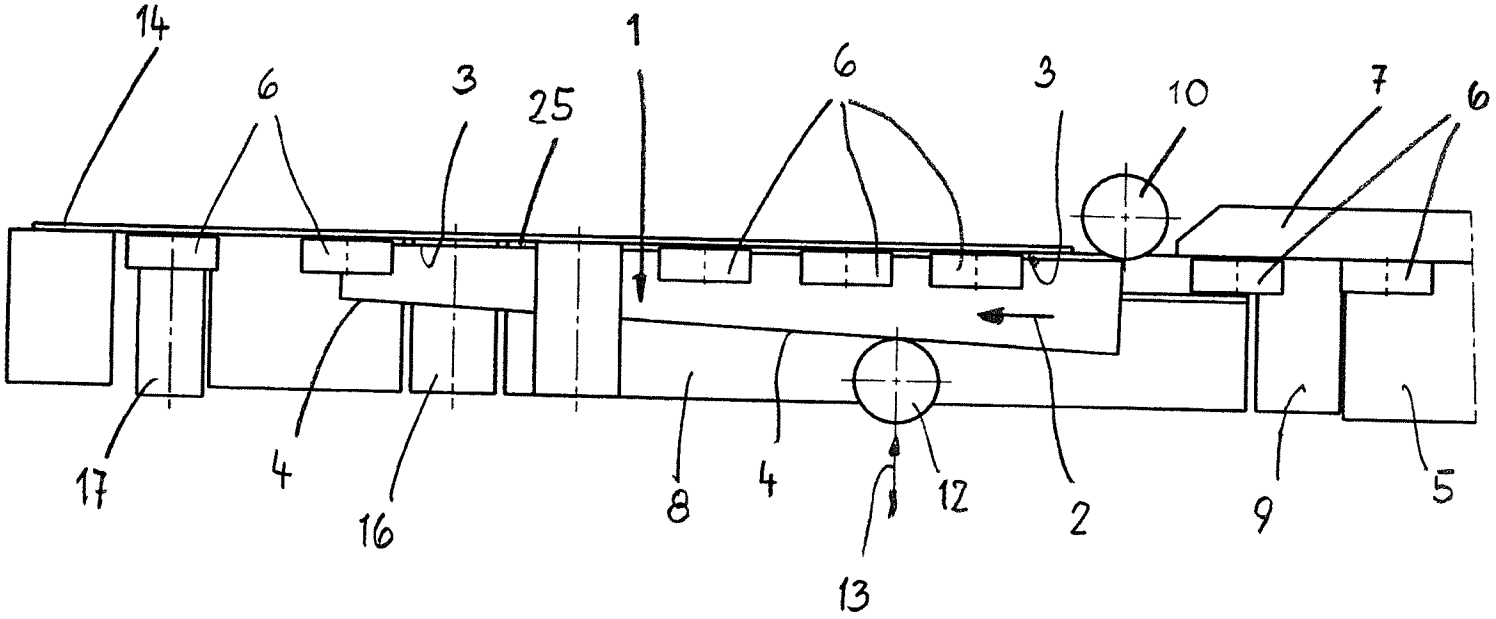
FIG. 2 is a plan view of a part of the machine according to FIG. 1.

This is illustrated in FIG. 2. The longitudinal side 3 of the workpiece 1 is machined by the tool 10 such that the longitudinal side 3 across the length of the workpiece 1 extends parallel to the throughfeed direction 2. The oppositely positioned longitudinal side 4 of the workpiece 1 is machined by the tool 12 such that the longitudinal side 4 extends straight across the length of the workpiece 1. Due to the slanted position of the longitudinal side 4, the tool 12, as can be seen in FIG. 2, is radially displaced continuously by CNC control in the adjusting direction 13.

The workpiece 1, prior to reaching the machine table 8, is provided at its bottom side 21 (FIGS. 1 and 4) with a groove 22 extending in the throughfeed direction 2. The groove 22 is milled by means of the dressing tool 9 into the bottom side 21.

The machine table 8 which is arranged on a machine frame 23 (FIG. 5) is provided with a protruding guide web 24 extending in the throughfeed direction 2 and engaging the groove 22 of the workpiece 1. The width of the guide web 24 is matched to the width of the groove 22 such that the workpiece 1 is guided properly in the throughfeed direction 2.

With the two tools 15 and 16, the topside as well as the bottom side of the workpiece 1 are planed as the workpiece 1 is fed through.

With the tool 16, the bottom side 21 of the workpiece 1 can be planed such that the groove 22 is removed. The groove 22 is only so deep that by means of the guide web 24 of the machine table 8 the workpiece 1 can be reliably guided. Therefore, only little material must be removed with the tool 16 at the workpiece bottom side 21 in order to remove the groove 22. The material loss is therefore very minimal.

Figure 5:
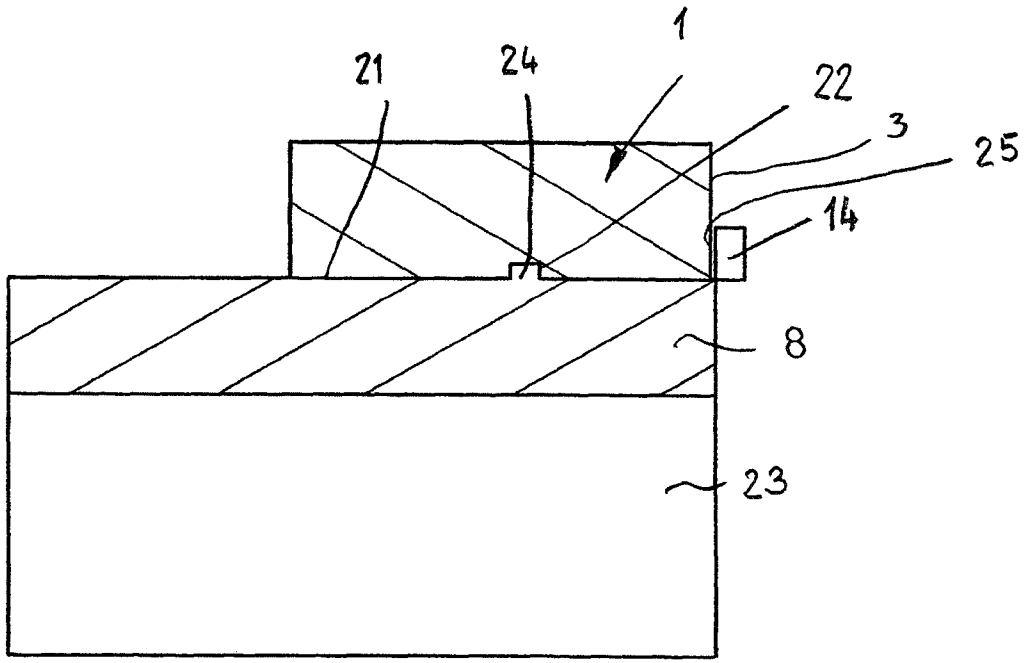
FIG. 5 shows in an enlarged illustration and in section a web guide of the machine according to the invention.

As can be seen in FIG. 5, between the right longitudinal side 3 of the workpiece 1 to the right in the throughfeed direction 2 and the fence 14, a minimal spacing 25 is provided so that it is ensured that the workpiece 1 upon throughfeed through the machine is guided only by the guide web 24 in the throughfeed direction 2.

When the workpiece 1 has a greater width transverse to the throughfeed direction 2, it can be advantageous to mill two grooves 22 into the bottom side 21 of the workpiece 1, for example; these grooves 22 are positioned at a spacing relative to each other in order to provide for a reliable guiding of the workpiece 1 even for a greater width. The dressing tool 9 is therefore correspondingly configured such that the grooves can be milled with the dressing tool 9.

Since the fence 14 does not serve for guiding the workpiece 1 through the machine, it is possible to properly conically plane workpieces where both longitudinal sides 3, 4 are positioned at an angle relative to the throughfeed direction 2 (FIG. 3). In this case, during throughfeed of the workpiece 1 through the machine, both tools 10, 12 are adjusted radially in the direction 11 or 13 in the described way in accordance with the slant of the longitudinal sides 3, 4. The adjustment of the tools 10, 12 during throughfeed of the workpiece 1 is realized again by means of the control unit which evaluates the signals of the sensors 18, 19 and, based thereon, produces the respective adjusting travel of the tools 10, 12 during throughfeed of the workpiece 1.

Such workpieces 1 with slanted longitudinal sides 3, 4 are also provided with at least one groove 22 at the bottom side 21, and the guide web 24 of the machine table 8 engages the groove 22. As in the preceding embodiment, the groove 22 is provided such that the workpiece 1 does not contact the fence 14.

The workpieces 1 are transported continuously through the machine. The spacing between workpieces 1 following each other can be kept small because the CNC control unit can adjust the tools 10, 12 precisely with respect to their position in a short period of time. Therefore, the machine has a high throughput per time unit.

After the workpieces 1 have been conically planed in the described way, they are joined in a subsequent method to larger elements. For example, the workpieces 1 can be arranged side by side with their longitudinal sides 3, 4, rotated alternatingly by 180°, respectively, and connected to each other by a glue connection. In a press, the workpieces resting against each other are pressed against each other such that stable panels are produced. They can be used, for example, as individual panels for various applications.

There is the possibility to stack two or more such panels and to glue them together in order to produce, for example, stable wall elements comprised of at least two layers. For such multi-layer panels, it is not required that the groove 22 at the bottom side of the workpiece is removed by milling. The panels can be stacked on each other such that the grooves are positioned at the faces of the panels facing each other. The grooves are then no longer visible from the exterior.

For producing such wall elements, it is also possible to place the alternatingly rotated workpieces 1 loosely side by side in order to form the first layer of the panel. A further layer of workpieces loosely placed side by side are then positioned on top of the first layer with preferably rectangular orientation relative to the boards of the first layer. A further panel layer with workpieces loosely placed side by side is then applied in the same orientation as the first layer. The layers that are resting on each other are then glued together across the surface and compressed. In this way, multi-layer panels with defined dimensions are manufactured, depending on the type of the press.

With the tools 10, 12, the longitudinal sides 3, 4 can be produced with high surface quality and high straightness so that the conical workpieces 1 subsequently can be reliably glued to panels in the afore described way.

When the workpieces 1 with the concave side 3 are placed against the fence 7, an optimal utilization of the wood is possible. The curvature can be measured by means of the sensor 18 in the described way. Based on this measurement, the control unit to which the sensor signals are transmitted can determine the required but minimal material removal at the longitudinal side 3. The workpieces 1 are supplied to the machine table 8 by contacting the fence 7 wherein the groove 22 is milled by means of the dressing tool 9 at the workpiece bottom side 21. Relative to the throughfeed direction 2, the right tool 10 is adjusted in the described way transverse to the throughfeed direction 2 by the control unit in accordance with the determined material removal and remains in its position during throughfeed of the workpiece 1. In this way, a very clean material removal is ensured at the longitudinal side 3 of the workpiece 1.

With the sensor 19 which is located at the left side in the throughfeed direction 2, the contour of the longitudinal side 4 is determined and based thereon the advancing travel of the tool 12 is determined. In this context, the leading axis is the feed travel of the workpiece 1 through the machine. The feed travel is determined by the feed rate with which the workpiece 1 is transported through the machine as well as by detecting the leading end of the workpiece in the machine.

For detecting the leading end of the workpiece 1, a sensor 26 is provided (FIG. 1 and FIG. 4) which is located in the region above the workpiece 1; the workpiece 1 is transported through the detection region of the sensor 26.

In principle, it is also possible to use the sensors 18, 19 for this purpose.

For determining the transport/feed travel, measuring wheels can be used also which are contacting the corresponding longitudinal side of the workpiece, advantageously the workpiece topside. Advantageously, a sensor can also be used here with which the leading end of the workpiece can be detected.

By means of the sensor 26 that detects the leading end of the workpiece 1 in combination with the adjusted feed rate and the sensors 18, 19, an exact and reliable adjustment of the tools 10, 12 is ensured.

Depending on the conicity of the raw workpieces 1, by adjustment of the adjusting rate of the tools 10 or 12 as a function of the feed travel or the feed rate of the workpieces 1, the workpieces 1 can be machined such that the respective longitudinal sides 3, 4 are differently slanted in relation to the throughfeed direction 2. In this way, defined conicity classes can be achieved. In this way, during later joining it is ensured that the conical workpieces 1 can be joined to plates or layers of boards which approximately have a rectangular shape.

In the described and illustrated embodiment, the workpieces 1 each are transported through the machine with their narrow end, the so-called head, leading. In principle, the workpieces 1 can also be arranged such that they are transported through the machine with their wider end leading.

Finally, it is also possible to carry out machining of the workpieces 1 during their throughfeed through the machine in such a way that the left tool 12 is fixed in position and the right tool 10 during throughfeed of the workpiece 1 is adjusted, as has been described with the aid of the left tool 12.

With the described machine and the described method, conical boards can be produced in a quality ready to be glued and with a very high raw wood yield. This high raw wood yield, i.e., the maximum board width, results from measuring the narrow sides of the workpieces and machining with minimal material removal based on the measurements, on the one hand, and from utilizing conical boards as starting material which are produced in an upstream process based on the naturally grown shape of the trees, on the other hand.

Figure 6:
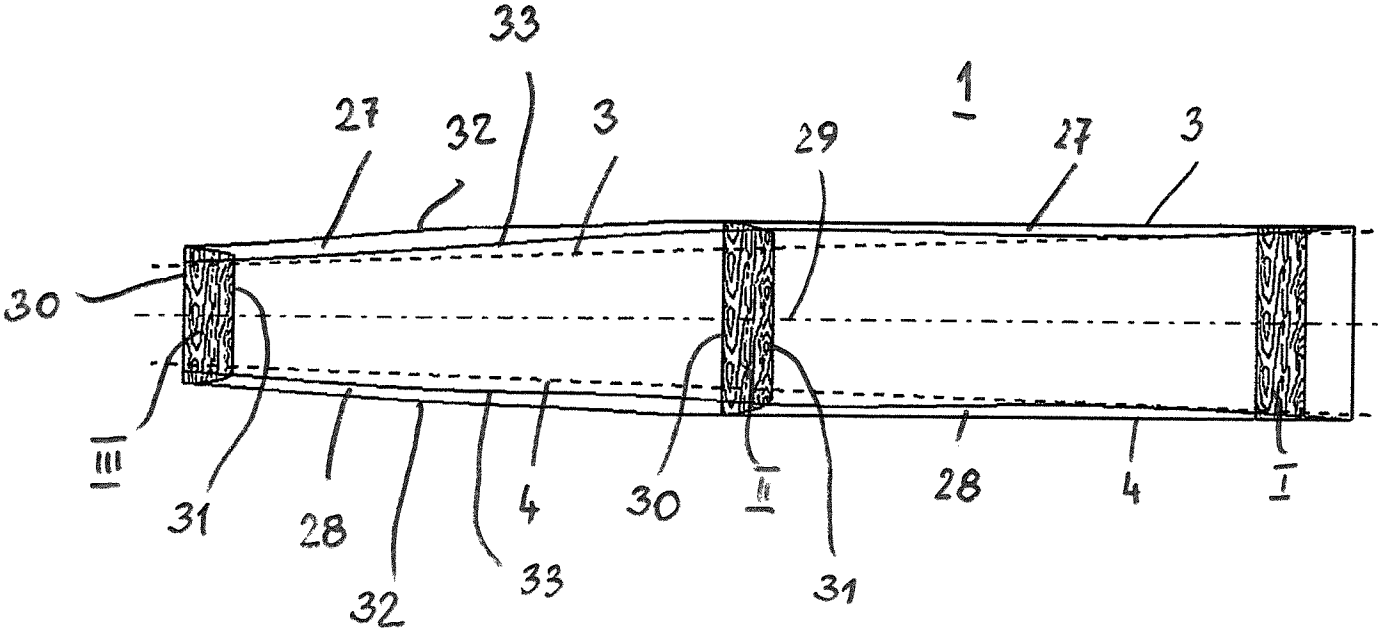
FIG. 6 shows in plan view a workpiece with wane.

FIG. 6 shows a workpiece 1 that has straight parallel trimmed sides 3, 4 which extend only across a portion of the workpiece length. In the embodiment, the sides 3, 4 extend across more than half of the length of the workpieces 1, advantageously across approximately two thirds of the length of the workpiece 1. This advantageous length of the straight trimmed sides 3, 4 is advantageous in regard to stacking of the workpieces after sawing. The sides 3, 4 in this case are sufficiently long so that the workpieces 1 with these sides 3, 4 resting against each other can be transported transverse to the longitudinal direction of the workpieces 1.

In the remaining part of the workpiece 1, the so-called wanes 27, 28 have not yet been machined by a trimming process and the workpiece 1 tapers toward its narrow end. Even in the trimmed region, viewed across the thickness of the workpiece, there may still be a wane portion.

FIG. 6 shows with dashed lines the workpiece 1 after machining. In this case, the workpiece 1 has continuous straight longitudinal sides 3, 4 across its length after machining; these sides 3, 4 converge in the direction toward the narrow end of the workpiece 1.

The workpiece 1 can be machined in such a way that it is embodied mirror-symmetrical relative to a symmetry line 29. For example, there is then the possibility to saw the workpiece 1, after machining, in the longitudinal direction along the symmetry line 29 into two workpieces (FIG. 10.3).

In FIG. 6, three workpiece cross-sections are illustrated. In the region of the straight sides 3, 4 at the leading end of the workpiece 1 where the workpiece 1 has been trimmed across its entire thickness, the workpiece 1 has a rectangular cross section I.

In the region where the workpiece 1 has not been completely or not at all trimmed across its thickness or across the wanes 27, 28, the unmachined workpiece 1 has the cross-sectional shape II or III. The wanes 27, 28 converge from the bottom side 30 of the workpiece 1 in the direction to its topside 31.

When the workpiece 1 has been finish-machined, it has a continuous rectangular cross section across its length, wherein the width of the workpiece 1 decreases continuously in the direction toward its narrow end.

When the workpieces 1 are used for inner layers of panels, small residual wane portions that can be defined with regard to size are to be accepted.

Since the wanes 27, 28 are positioned at a slant, the unmachined workpiece during its transport in the direction toward the tools of the machine is measured from the topside, preferably by means of scanners. The scanners are arranged such that they measure or scan the bottom edge 32 and the top edge 33 of the wanes 27, 28. The tools 10, 12 can then be adjusted such that the desired contour of the workpiece 1 can be produced with minimal material removal.

As has been explained with the aid of the preceding embodiment, the workpiece 1 in addition can be measured with regard to its length as well the leading end and the trailing end of the workpiece 1 by the sensors 18, 19, 26 (FIG. 4).

The desired conicity (dashed lines) of the workpiece 1 can be adjusted such that the finish-machined workpiece can be correlated with a certain conicity class.

As acquisition devices that measure or scan the workpiece 1 from above, imaging systems such as cameras but also transverse throughfeed scanners, lengthwise throughfeed scanners, and the like can be used. The workpieces 1 are arranged on the straightening table 5 or the machine table 8 during feeding in such a way that the wanes 27, 28 extend from the contact side 30 upwardly and at a slant inwardly. In this way, the acquisition or scanning devices which are arranged in the region above the workpiece 1 can capture the two edges 32, 33 of the wanes 27, 28.

The acquisition device is advantageously arranged in the feed region where the workpieces 1 are fed to the machine.

As in the preceding embodiments, the respective workpiece identification in the machine can be ensured by exact tracking of the workpieces or by means of an identification marker, for example, barcode, transponder or the like.

In deviation from the embodiment according to FIG. 6, the workpieces 1 can be untrimmed. Depending on the grown shape and the course of the wane 27, 28, the unmachined workpiece 1 can also be conically trimmed or, as in the illustrated embodiment, can be trimmed parallel across a partial length.

Figure 7:
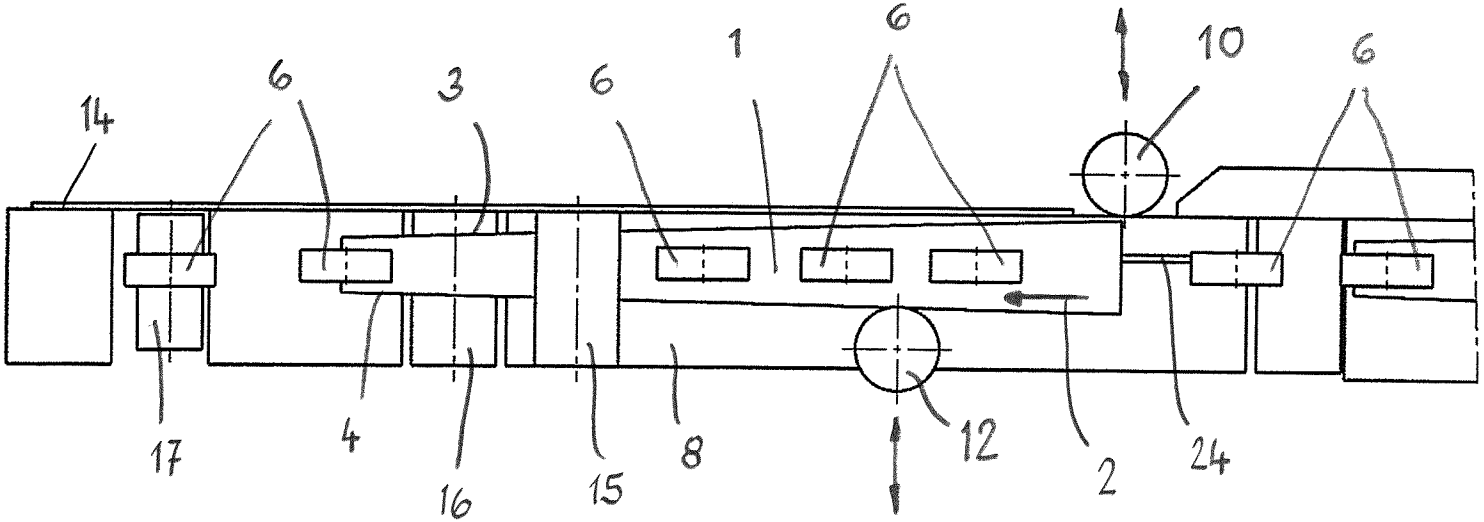
FIG. 7 shows in an illustration corresponding to FIG. 3 a further embodiment of a machine according to the invention.

FIG. 7 shows a machine which is in principle of the same configuration as the embodiment according to FIG. 3. The difference resides in that the feed/transport rollers 6, in plan view, are positioned approximately at half the width of the workpiece 1. In the embodiment according to FIG. 3, the feed/transport rollers 6 are positioned immediately neighboring the fence 14, viewed in plan view of the machine. Due to the central arrangement of the feed/transport rollers 6, a reliable feed action of the workpiece 1 through the machine is ensured.

This feed/transport rollers 6 are advantageously adjustable transverse to the throughfeed direction 2 of the workpiece 1 so that the feed/transport rollers can be optimally adjusted as a function of the width of the workpiece 1.

Figure 8:
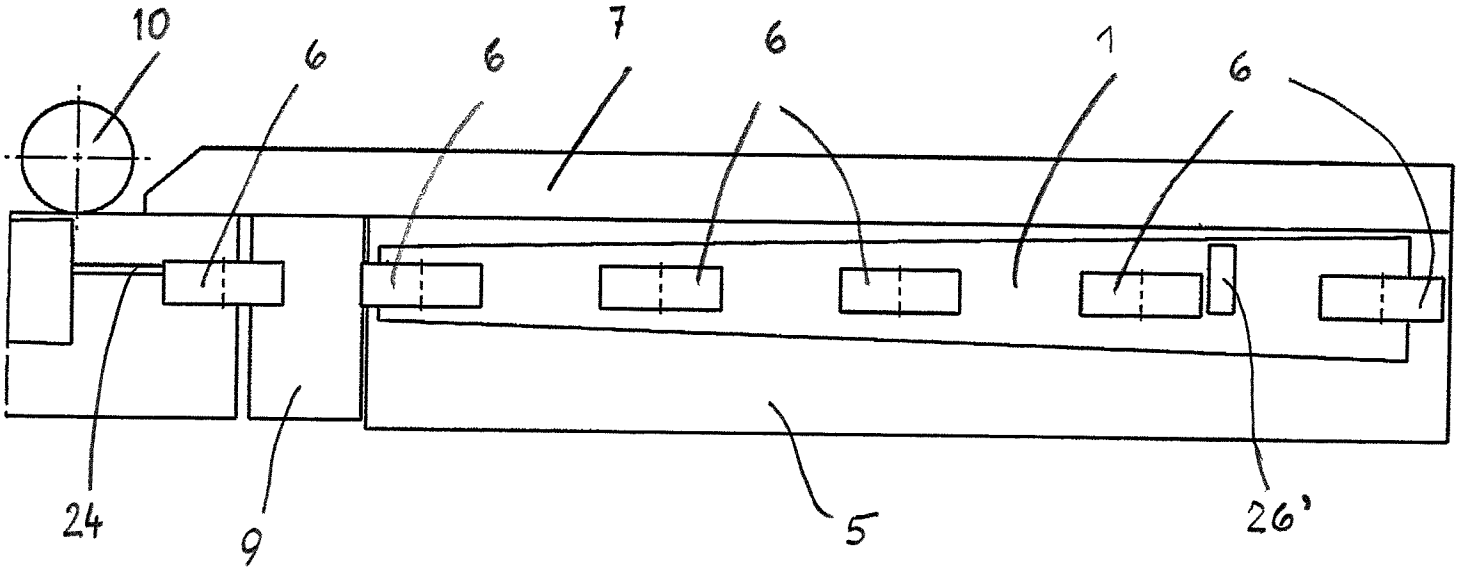
FIG. 8 is a plan view of a further embodiment of the machine according to the invention.

FIG. 8 shows the infeed region of the throughfeed machine according to FIG. 7 with the straightening table 5 on which the workpieces 1 are supplied to the machine. For transporting the workpieces 1, the feed/transport rollers 6 are provided which are positioned at a spacing one behind the other approximately at half the width of the workpiece 1. The feed/transport rollers 6 are adjustable relative to the width of the workpiece 1 so that the workpiece 1 can be transported reliably through the machine.

FIG. 8 shows the infeed of the workpiece 1 into a moulding machine; the workpiece 1 is machined in the same way as has been explained with the embodiment of FIG. 3. The workpiece 1 according to FIG. 8 is conically embodied on both sides and can be an untrimmed conical or a conically trimmed workpiece. However, it can also be trimmed parallel across the entire length or at least across a partial length.

Based on FIGS. 9.1, 9.2, 9.3, an advantageous method sequence for machining the workpiece 1 is described. The workpiece 1 is fed in from a stack (not illustrated) transverse to its longitudinal direction. The workpiece 1 can be partially trimmed, trimmed or untrimmed and can have optionally the wanes 27, 28.

During feeding, the workpiece 1 is scanned from above by a transverse throughfeed scanner 26" (dotted lines in step 1 of FIG. 9.1) so that in the described way in particular in the region of the wanes 27, 28 their bottom edge 32 as well as their top edge 33 can be captured. Also, during the scanning process the leading end and the trailing end of the workpiece 1 can be detected and the corresponding measured values can be transmitted to the control unit. Based on the scanning process, the advantageous future alignment for feeding into the machining region of the machine is determined. In the described way, the control unit then ensures that the tools can be adjusted such that the required material removal is carried out at the longitudinal sides of the workpiece 1.

Depending on the feed direction, the scanning process can be realized by a transverse throughfeed scanner 26" or a longitudinal throughfeed scanner.

As soon as the workpiece 1 has reached the straightening table 5 (FIG. 1), it is aligned transverse to its longitudinal direction. This is illustrated in step 2 in FIG. 9.2 by symbolically indicated stops 34.

Advantageously, trimmed workpieces are placed against the fence 7, as explained in connection with FIG. 1, and then fed to the machining process. In case of an incompletely trimmed wane, it is expedient that the right tools 10, 10' during throughfeed machining can be transversely adjusted also and machine the workpiece 1 conically.

On the straightening table 5, the position of the workpiece 1 to be machined is possibly checked again or monitored by means of a further scanner 26' (FIG. 8). In particular, the alignment of the workpiece in relation to the throughfeed direction 2 is also checked. As needed, a correction of the desired machining can be performed based thereon by means of the CNC control unit by appropriately adjusting the corresponding tool transverse to the throughfeed direction 2.

Machining to be performed on the workpiece 1 is indicated in step 2 of FIG. 9.2 in an exemplary fashion by the lines 35, 36. These lines 35, 36 indicate that the workpiece 1 after having been machined across its entire length is of a conically tapering shape. The machining lines 35, 36 converge in the throughfeed direction 2.

At the bottom side 21 of the workpiece 1, the groove 22 is milled by means of the dressing tool 9 (FIGS. 1 and 4); see position 3.1 in FIG. 9.3.

Subsequently, the workpiece 1 to the right and to the left is pre-machined/pre-planed (position 3.2 in FIG. 9.3). In this embodiment, the right tools 10, 10' and left tools 12, 12', viewed in throughfeed direction 2, are positioned directly opposite to each other.

Subsequently, the workpiece 1 is finish-planed (position 3.3 of FIG. 9.3) at the longitudinal sides extending in the throughfeed direction 2 by means of the corresponding tools 10', 12'.

Finally, at position 3.4, the workpiece is finish-planed at the topside and at the bottom side by means of the corresponding tools 15, 16 (FIG. 1) so that the thickness of the workpiece 1 is set.

During throughfeed of the workpiece 1, the tools 10, 12; 10', 12' are continuously adjusted in a direction transverse to the throughfeed direction 2 in accordance with the desired conicity angle, as has been explained in connection with the first embodiment in detail.

The workpieces 1 which have been machined according to method steps shown in FIGS. 9.1, 9.2, 9.3 can subsequently be further processed in various ways.

Figure 9B:
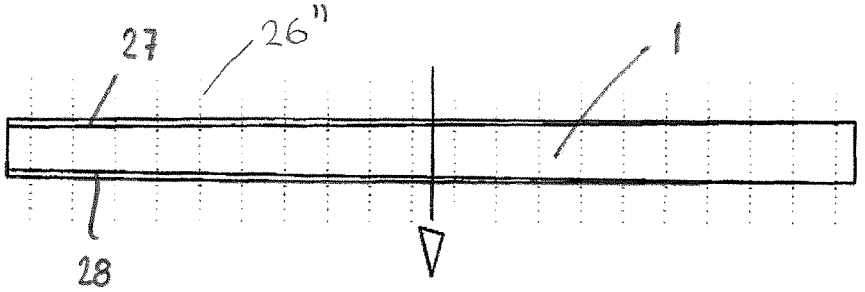
FIGS. 9*a* and 9*b* show in schematic illustration embodiments of the method of forming board pairs.
Figure 9B:
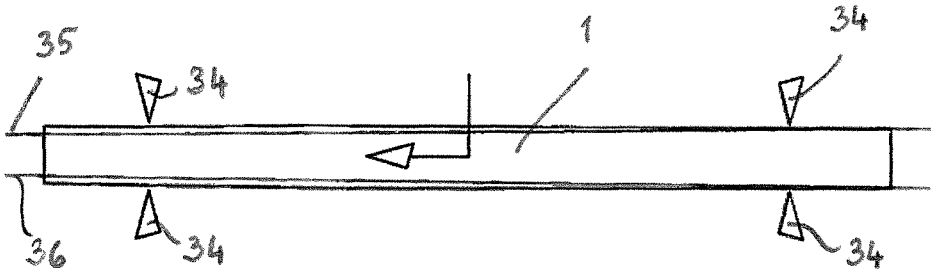
Figure 9B:
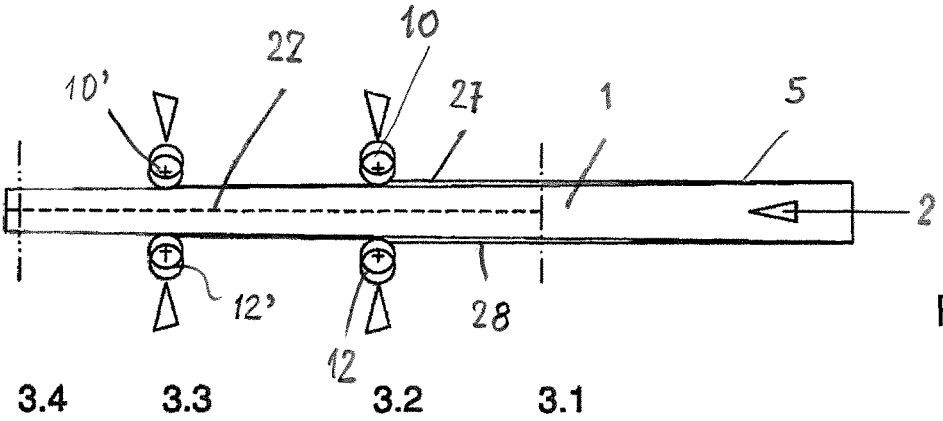
Figure 9B:
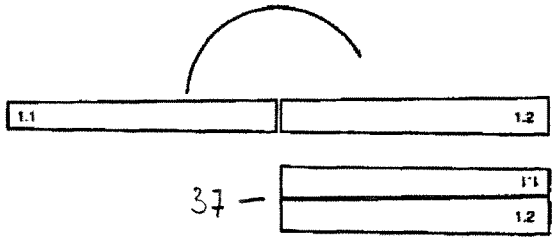
Figure 9A:
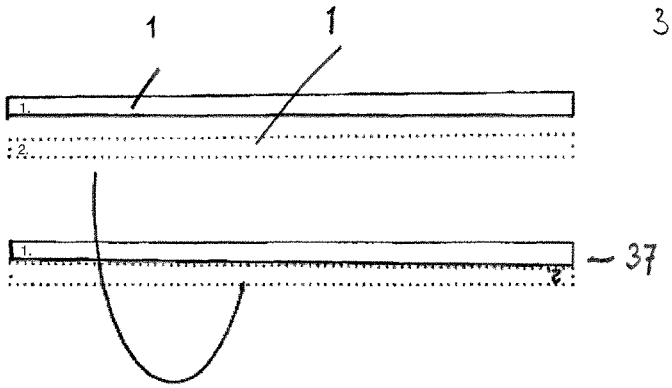

In the method variant according to FIG. 9*a*, the conical workpieces 1 are placed against each other in a rotated position so that a board pair 37 results which is formed of two workpieces 1 resting against each other, wherein the board pair 37 has parallel longitudinal sides and an approximately rectangular contour.

In FIG. 9*a*, one workpiece 1 is identified by "1." and the second workpiece by "2.". The two workpieces have the same conicity and are advantageously removed from an intermediate storage (not illustrated). The workpiece "2." is rotated about an axis that is transverse to the longitudinal workpiece direction so that the narrow end of the workpiece "2." is positioned adjacent to the wider end of the workpiece "1." and the wider end of workpiece "2." is adjacent to the narrow end of workpiece "1.".

In this way, board pairs are formed wherein the corresponding workpieces are advantageously removed from the intermediate storage.

In another method variant (FIG. 9*b*), the workpieces are first separated into two workpiece parts 1.1 and 1.2 of identical length. Then one of the two workpiece parts is rotated such that with its narrow end is positioned adjacent to the wider end of the other workpiece part. The thus formed board pair 37 has also parallel longitudinal sides but is only half as long as the board pair 37 according to FIG. 9*a*.

In the method according to FIG. 9*b*, an intermediate storage is not required because the workpieces 1 are immediately separated into the two workpiece parts 1.1 and 1.2 after their machining.

The board pairs 37 according to FIGS. 9*a* and 9*b* formed of two adjacently positioned workpieces are subsequently placed side by side with their longitudinal sides to form an array of boards and then joined to each other, preferably glued to each other, in a suitable way. The manufacture of such board arrays is known and is therefore not explained here in detail.

Based on FIGS. 10.1, 10.2, 10.3, a further possibility is described as to how to machine workpieces 1 and further process them. The steps shown in FIGS. 10.1 and 10.2 corresponds substantially to the steps according to FIGS. 9.1 and 9.2. In the step of FIG. 10.2, the workpiece is however oriented such that its symmetry axis 29 extends in the throughfeed direction 2 and is positioned opposite a splitting saw (not illustrated) such that the workpiece 1 is separated across its length preferably at half its width.

In the step shown in FIG. 10.3, the operations performed at positions 3.1 to 3.3 are performed in the same manner on the workpiece 1 as in the embodiment according to FIG. 9.3 wherein the conical machining of the two longitudinal sides is also carried out symmetrical, i.e., at the same angle.

At the position 3.4 of FIG. 10.3, the sawing action in length direction of the workpiece 1 upon its transport in throughfeed direction 2 is realized. The corresponding splitting saw (not illustrated) is located advantageously in the region below the workpiece 1 but can also be provided in the region above the workpiece 1 such that the workpiece 1 is separated in longitudinal direction. The cut 38 which is produced by the splitting saw is positioned along an axis which is parallel to the symmetry axis 29 of the workpiece 1. Preferably, the cut 38 is positioned in the symmetry axis 29 so that the workpiece 1 is separated at half its width.

Finally, at position 3.5 of FIG. 10.3, the workpiece 1 is planed at the topside and bottom side, and the desired thickness of the board is produced in this way.

FIG. 10*a* shows the two workpiece parts 1.1, 1.2 produced after separation of the workpiece 1 in the step of FIG. 10.3. Both workpiece parts 1.1, 1.2 have parallel extending longitudinal sides 40, 41 as a result of the separating cut 38. The outer longitudinal sides 3, 4 are positioned at an angle relative to these longitudinal sides 40, 41. Accordingly, the workpiece parts 1.1, 1.2 have a wide end and a narrow end.

Board pairs 37 are formed of the two workpiece parts 1.1, 1.2 so that parallel outer longitudinal sides are formed also. For example, the workpiece part 1.2 is rotated about an axis which is transverse to its longitudinal direction.

From the thus formed board pairs 37, as has been explained above, the array of boards is formed.

Since the workpieces 1 in the operation at position 3.5 are separated in the direction of their length, the thus resulting workpiece parts 1.1 and 1.2 can be immediately further processed. No intermediate storage for the workpiece parts is required.

A further possibility resides in depositing the workpieces 1 in different intermediate stores not only by taking into consideration the conicity class but also by taking into consideration the positions of knots in the workpieces (e.g., leading end of the workpiece, center part of the workpiece, trailing end of the workpiece). The workpiece 1 can then be removed from the intermediate stores and joined to the array of boards such that only little waste is produced in the future method step of knot removal.

As can be taken from the described embodiments, aside from the workpieces 1 which are conically trimmed across their entire length, workpieces that are parallel trimmed across at least a partial length or untrimmed workpieces can also be subjected to the described planing action (FIG. 6).

Measuring the workpiece from the side by means of the sensors 18, 19, as explained in connection with FIG. 4, lends itself only to use in connection with completely trimmed workpieces 1. With these sensors 18, 19 the effect of a wane 27, 28 (FIG. 6) at the workpiece 1 cannot be detected in general. For workpieces with wanes, advantageously scanners or cameras are used that measure the workpiece 1 from above. In this context, the top and bottom lateral edges 32, 33 of the wanes 27, 28 can be captured. Decisive in this context for determining the conical machining action are the top lateral edges 33 of the wanes 27, 28 because they have a greater effect on the planing action.

In the method according to FIGS. 9.1, 9.2, 9.3, the workpieces 1 are respectively scanned and in this context the conical machining position with consideration of the conicity classes is determined. Subsequently, the workpieces are fed to the moulding machine and aligned in accordance to the processing position. Optionally, the orientation of the workpiece 1 during transport in the moulding machine is checked and, if needed, a machining correction is carried out. At the bottom side of the workpiece, the form-fit element in the form of the groove 22, where the guide web 24 of the moulding machine will engage, is produced in the described way.

Upon throughfeed of the workpiece 1 through the moulding machine, conical machining will be performed in that the corresponding tool is adjusted transverse to the throughfeed direction 2. The thus produced conical workpieces 1 are subsequently stored in an intermediate store in accordance with their conicity class. From this intermediate store, the workpieces are then supplied, in the method according to FIG. 9*a*, for forming an endless array of boards wherein two workpieces form the board pairs 37, respectively; the board pairs 37 are arranged side by side for forming the array of boards. The board pairs 37 are assembled from workpieces 1 of the same conicity class. One of these workpieces is rotated in the described way in its plane about a transverse axis by 180°. In this way, the two conical workpieces "1.", "2." (FIG. 9*a*) form the board pair 37 with parallel longitudinal sides and with a substantially rectangular contour.

In the method according to FIG. 9*b*, the workpieces 1 are scanned for determining the conical processing position. Taking into consideration the conicity classes is not needed in this method because the workpiece parts 1.1, 1.2 are not stored in intermediate stores but are immediately further processed. The scanned workpiece 1 is supplied to the moulding machine and is oriented in accordance with the processing position. Optionally, the alignment of the workpiece 1 during transport in the molding machine is checked. If needed, a correction of the machining action by a corresponding adjustment of the tool is carried out. At the bottom side 21 of the workpiece, the groove 22 is produced which is engaged by the guide web 24. By adjustment of the tool transverse to the throughfeed direction 2, conical machining of the workpiece 1 is carried out. Subsequently, the workpiece 1 is separated by transverse separation into the two workpiece parts 1.1 and 1.2. One of these workpiece parts is subsequently rotated by 180° in its plane. The workpiece parts 1.1, 1.2 are then joined in the described way to board pair 37. From the thus formed board pairs 37 the endless array of boards is produced wherein this array has a width that corresponds to half the length of the starting workpieces 1.

In the method according to FIGS. 10.1, 10.2, 10.3, the workpieces 1 are first scanned and in this context the conical machining position determined. Also, the central axis of the workpiece 1 is determined which extends in the throughfeed direction 2. Subsequently, the workpiece 1 is fed to the moulding machine and is aligned in accordance with the determined central axis 29. During transport of the workpiece 1 in the moulding machine, the workpiece alignment can be optionally checked. Optionally, a correction of the machining action is carried out in that the tool is adjusted accordingly. At the bottom side 21 of the workpiece, the groove 22 for the guide web 24 is provided. Then the workpiece is conically machined by corresponding adjustment of the tool upon throughfeed of the workpiece through the moulding machine. At the end, the separation process takes place in the described way so that the workpiece 1 is separated in its longitudinal direction into the two workpiece parts 1.1 and 1.2. Since these workpiece parts 1.1, 1.2 are immediately further processed subsequently, an intermediate store is not required. Also, in this way processing according to conicity classes is not required because two workpiece parts cut from the same workpiece are placed against each other for forming the board pairs 37 that have parallel outer longitudinal sides. These board pairs are joined side by side to the endless board array.

While in the machine according to FIGS. 1 through 5 only one tool 10, 12 is provided for machining the longitudinal sides of the workpiece 1, the schematically illustrated moulding machine of FIGS. 9.1, 9.2, 9.3 and FIGS. 10.1, 10.2, 10,3 has two right tool 10, 10' and two left tools 12, 12' that are positioned at a spacing behind each other, respectively. These tools are correspondingly adjusted for conical machining of the workpieces, respectively. The right and left tools 10, 10' and 12, 12' are positioned advantageously opposite each other so that the cutting forces acting transverse to the throughfeed direction 2 can be compensated. In this way, also the load that is exerted on the groove 22 and the guide web 24 engaging the groove 22 is minimized. With the tools 10, 10'; 12, 12', the workpiece can be pre-machined or finish-machined. This is advantageous in connection with greater material removal required, for example, in case of untrimmed workpieces or workpieces that are only partially trimmed across the workpiece length.

In the described embodiments, the lateral sides are machined with the vertical tools 10, 10', 12, 12' such that the sides of the workpieces are positioned at a right angle to the top side and the bottom side of the workpiece. It is furthermore possible to machine the longitudinal sides 3, 4 of the workpieces 1 with tools positioned at a slant or with profiling tools. In this way, the longitudinal sides 3, 4 are embodied at a slant relative to the top side and the bottom side. The workpieces have therefore a trapezoidal cross section. In this way, the wood yield can be significantly increased.

When machining with tools 10, 10'; 12, 12' in slanted position, the spindles on which the tools 10, 10'; 12, 12' are seated are designed such that they can be pivoted about an axis which is extending parallel to the throughfeed direction 2. The pivot angle, like the conicity, is determined in accordance with the shape and position of the wane based on the data of the scanned workpieces 1. By means of the machine control unit, the tools 10, 10'; 12, 12' are pivoted preferably by means of CNC-controlled drive axes into the corresponding position.

For forming the board pairs 37, one workpiece part 1.2 (FIG. 10*b*) is rotated, in addition to the 180° rotation in the plane, so that the bottom side becomes the topside before the workpieces or workpiece parts, resting against each other, are joined for forming the array of boards. This rotation has the result that, as shown in FIG. 10*b*, the two workpiece parts 1.1, 1.2 with their longitudinal sides 3, 4 extending at a slant are resting against each other. The longitudinal side 40 of the workpiece part 1.2 becomes an outer side of the board pair 37, the longitudinal side 41 of the other workpiece part 1.1 forms the other outer side of the board pair 37.

The specification incorporates by reference the entire disclosure of German priority document 10 2018 002 704.0 having a filing date of Mar. 29, 2018 and of German priority document 10 2019 001 921.0 having a filing dated of Mar. 16, 2019.

While specific embodiments of the invention have been shown and described in detail to illustrate the inventive principles, it will be understood that the invention may be embodied otherwise without departing from such principles.

What is claimed is:

1. A method for machining boards of wood or plastics, the method comprising:

feeding boards in a transport direction through a machine comprising two or more rotatably driven tools, wherein a length direction of the boards extends in the transport direction and the boards are transported horizontally on a flat bottom side thereof through the machine;

machining boards on at least one of a right longitudinal side and a left longitudinal side of the boards extending in the transport direction of the boards and adjoining the flat bottom side by:

a) measuring the boards prior to or during feeding at least in regard to a conicity to be machined;

b) producing at the boards at least one form-fit element configured to interact with at least one counter form-fit element during feeding of the boards and linearly guiding the boards in the transport direction through the machine;

c) continuously adjusting at least one of the two or more rotatably driven tools in relation to at least one of the right longitudinal side and the left longitudinal side of the boards transverse to the transport direction during feeding of the boards through the two or more rotatably driven tools to machine at least one of the right longitudinal side and the left longitudinal side of the boards to produce at least one conically tapering straight longitudinal side based on the conicity measured in the step a).

2. The method according to claim 1, further comprising detecting a position of the boards in relation to the two or more rotatably driven tools.

3. The method according to claim 1, further comprising:

providing measuring elements and detecting with the measuring element in the step a) a width and/or the conicity of the boards; and transmitting signals of the measuring elements to a control unit connected to the two or more rotatably driven tools.

4. The method according to claim 1, further comprising arranging the boards to board pairs comprising approximately parallel longitudinal sides and an approximately rectangular contour.

5. The method according to claim 4, further comprising combining the board pairs to arrays of boards.

6. The method according to claim 1, further comprising, subsequent to conical machining, separating the boards into two board parts, rotating one of the two board parts, and forming together with the other one of the two board parts a board pair.

7. The method according to claim 1, further comprising, subsequent to conical machining, separating the boards at half a length of the workpieces to form two board parts.

8. The method according to claim 1, further comprising, subsequent to conical machining, separating the boards along an axis parallel to a symmetry axis of the boards to form two board parts.

9. A method for machining boards of wood or plastics, the method comprising:

feeding boards in a transport direction through a machine comprising two or more rotatably driven tools, wherein a length direction of the boards extends in the transport direction and the boards are transported horizontally on a flat bottom side thereof through the machine;

machining boards on at least one of a right longitudinal side and a left longitudinal side of the boards extending in the transport direction of the boards and adjoining the flat bottom side by:

a) measuring the boards prior to or during feeding at least in regard to a conicity to be machined;

b) producing at the boards at least one form-fit element configured to interact with at least one counter form-fit element during feeding of the boards and linearly guiding the boards in the transport direction through the machine;

c) continuously adjusting at least one of the two or more rotatably driven tools in relation to at least one of the right longitudinal side and the left longitudinal side of the boards transverse to the transport direction during feeding of the boards through the two or more rotatably driven tools to machine at least one of the right longitudinal side and the left longitudinal side of the boards to produce at least one conically tapering straight longitudinal side based on the conicity measured in the step a);

d) joining two of the boards to each other by placing the respective at least one conically tapering straight longitudinal side against each other to form a board pair comprising approximately parallel longitudinal sides and an approximately rectangular contour and, prior to joining, rotating a first one of the two boards about an axis perpendicular to the bottom side of the first board.

10. The method according to claim 9, further comprising placing a plurality of the board pairs with the respective longitudinal sides next to each other to form an endless array of boards and fixedly joining the plurality of the board pairs to each other.

11. A method for machining boards of wood or plastics, the method comprising:

feeding boards in a transport direction through a machine comprising two or more rotatably driven tools, wherein a length direction of the boards extends in the transport direction and the boards are transported horizontally on a flat bottom side thereof through the machine;

machining boards on at least one of a right longitudinal side and a left longitudinal side of the boards extending in the transport direction of the boards and adjoining the flat bottom side by:

a) measuring the boards prior to or during feeding at least in regard to a conicity to be machined;

b) producing at the boards at least one form-fit element configured to interact with at least one counter form-fit element during feeding of the boards and linearly guiding the boards in the transport direction through the machine;

c) continuously adjusting at least one of the two or more rotatably driven tools in relation to at least one of the right longitudinal side and the left longitudinal side of the boards transverse to the transport direction during feeding of the boards through the two or more rotatably driven tools to machine at least one of the right longitudinal side and the left longitudinal side of the boards to produce at least one conically tapering straight longitudinal side based on the conicity measured in the step a);

d) transversely cutting a respective board into two board parts about an axis transverse to the length direction of the respective board so that each of the two board parts comprises a conically tapering section of the at least one conically tapering straight longitudinal side;

e) rotating one of the board parts by 180° about an axis perpendicular to the bottom side and joining the two board parts by placing the conically tapering sections against each other to form a board pair comprising approximately parallel longitudinal sides and an approximately rectangular contour.

12. The method according to claim 11, further comprising placing a plurality of the board pairs with the respective longitudinal sides next to each other to form an endless array of boards and fixedly joining the plurality of the board pairs to each other.

13. A method for machining boards of wood or plastics, the method comprising:

feeding boards in a transport direction through a machine comprising two or more rotatably driven tools, wherein a length direction of the boards extends in the transport direction and the boards are transported horizontally on a flat bottom side thereof through the machine;

machining boards on at least one of a right longitudinal side and a left longitudinal side of the boards extending in the transport direction of the boards and adjoining the flat bottom side by:

a) measuring the boards prior to or during feeding at least in regard to a conicity to be machined;

b) producing at the boards at least one form-fit element configured to interact with at least one counter form-fit element during feeding of the boards and linearly guiding the boards in the transport direction through the machine;

c) continuously adjusting the two or more rotatably driven tools in relation to the right longitudinal side and the left longitudinal side of the boards transverse to the transport direction during feeding of the boards through the two or more rotatably driven tools to machine the right longitudinal side and the left longitudinal side of the boards to produce conically tapering straight longitudinal sides based on the conicity measured in the step a);

d) cutting a respective board into two board parts in the length direction of the respective board;

e) rotating one of the two board parts by 180° about an axis perpendicular to the bottom side and by 180° about the length direction;

f) joining the two board parts by placing the conically tapering straight longitudinal sides against each other to form a board pair comprising approximately parallel longitudinal sides and an approximately rectangular contour.

14. The method according to claim 13, further comprising placing a plurality of the board pairs with the respective longitudinal sides next to each other to form an endless array of boards and fixedly joining the plurality of the board pairs to each other.

* * * * *